US006197436B1

(12) United States Patent
Zayets et al.

(10) Patent No.: US 6,197,436 B1
(45) Date of Patent: Mar. 6, 2001

(54) METHOD AND COMPOSITION FOR DIFFUSION ALLOYING OF FERROUS MATERIALS

(75) Inventors: Inna I. Zayets; Lidia O. Chunayeva; Grigory A. Tkach, all of Kharkiv (UA)

(73) Assignee: Jamar Venture Corporation, Cincinnati, OH (US)

( * ) Notice: Subject to any disclaimer, the term of this patent is extended or adjusted under 35 U.S.C. 154(b) by 0 days.

(21) Appl. No.: 09/284,365

(22) PCT Filed: Oct. 23, 1997

(86) PCT No.: PCT/US97/19278

§ 371 Date: Aug. 2, 1999

§ 102(e) Date: Aug. 2, 1999

(87) PCT Pub. No.: WO98/18978

PCT Pub. Date: May 7, 1998

(51) Int. Cl.[7] ..... C23C 16/30; C22C 29/02; B21D 39/00

(52) U.S. Cl. ..... 428/622; 428/627; 428/629; 428/684; 427/249.18; 427/252; 427/253; 427/255.4; 75/235; 75/239

(58) Field of Search ..... 427/249.18, 250, 427/252, 253, 255.4; 428/622, 627, 629, 684; 75/235, 239

(56) References Cited

U.S. PATENT DOCUMENTS 4,234,668 * 11/1980 Park et al. .
4,276,088 6/1981 Zaets et al. .
4,963,395 10/1990 Lewis et al. .

FOREIGN PATENT DOCUMENTS 4238220 12/1992 (DE) .
4238220 * 5/1993 (DE) .
981794 5/1961 (EP) .
1002820 9/1962 (EP) .
2206898 6/1988 (GB) .
2206898 * 1/1989 (GB) .

* cited by examiner

*Primary Examiner*—Timothy Meeks
(74) *Attorney, Agent, or Firm*—Biebel & French

(57) ABSTRACT

A method for diffusion coating workpieces of ferrous base metals such as carbon steel and cast iron includes the step of weighing and mixing the following components, in powdered form:

| | |
|---|---|
| Chromium | 40–50 wt % |
| Ferrochromium | 25–37 wt % |
| Tantalum Carbide | 0.40–0.65 wt % |
| Vanadium | 0.35–0.70 wt % |
| Ammonium Halide | 4–5 wt % |
| Aluminum Oxide | Remainder |

The workpieces are preferably degreased and then placed in a container with the mixed components. The container is sealed and heated to a temperature of 1000°–1050° C. The workpieces and the composition are kept at that temperature for a predetermined period, on the order of forty-five minutes or longer, to permit a surface layer of desired thickness to form. The container is then cooled in a conventional cooling chamber and the workpieces are removed. The method produces coatings having good wear and corrosion resistance.

12 Claims, No Drawings

METHOD AND COMPOSITION FOR DIFFUSION ALLOYING OF FERROUS MATERIALS

BACKGROUND OF THE INVENTION

1. Field of the Invention

The present invention relates to a composition and method for diffusion coating ferrous metals, and more particularly to a method for diffusion coating ferrous metals using a pulverous coating composition including chromium and ferrochromium.

2. Description of Related Art

Carbon steels are frequently used in various industries due to their high plasticity, that is, their ability to deform inelastically without rupture at high stresses. This high plasticity, in turn, makes carbon steels relatively easy to machine, process and treat.

One drawback to the use of carbon steels and cast iron is their low wear resistance and low corrosion resistance. For this reason, these materials are often subjected to surface treatments to increase their resistance to wear and corrosion. Prior investigations have shown that the diffusion coating of parts with alloys of the transition metals, especially alloys of chromium, produces dense protective layers which are connected reliably to the base metals of the parts.

Various compositions have been proposed for the diffusion coating of ferrous base metals. One such composition has the following components:

| | |
|---|---|
| Chromium | 50 wt % |
| Aluminum Oxide | 43–45 wt % |
| Ammonium Chloride | 5–7 wt %. |

The diffusion coating of carbon-containing ferrous base metals with this composition produces a surface layer comprising a solid solution of chromium in iron with a discontinuous chromium carbide phase.

Such surface layers have been found to be susceptible to fracture, leading to a relatively short coating life. This is believed to be due to the failure of the coating. Such surface layers also have been found to be insufficiently resistant to corrosion, especially in weak acidic or chloridic solutions at high temperatures.

Another proposed diffusion coating composition uses ferrochromium:

| | |
|---|---|
| Ferrochromium | 70 wt % |
| Aluminum Oxide | 29 wt % |
| Chromium Ammonia | 1 wt % |

The wear resistance of ferrous base metals diffusion-coated with this composition is very low.

Various microadditions, such as boron and molybdenum, have been proposed for increasing the wear resistance of chromium-based diffusion coatings. For example, German Patent No. 36 04 309 proposed the following composition for use in diffusion coating metal:

| | |
|---|---|
| Chromium | 67 wt % |
| Molybdenum Boride | 3 wt % |

-continued

| | |
|---|---|
| Aluminum Oxide | 29 wt % |
| Ammonium Chloride | 1 wt %. |

Such microadditives tend to enhance the formation of a continuous upper surface carbide layer and thereby meaningfully increase the corrosion resistance and wear resistance of the finished part.

Nonetheless, coatings formed on carbon-containing ferrous base metals from chromium-based compositions including boron or molybdenum microadditives lack sufficient resistance to aggressively corrosive solutions such as calcium chloride, sulfur-containing petroleum and mineral oil. Furthermore, prior art coating compositions have required relatively large amounts of these relatively expensive microadditives (from approximately 2–5 wt %) which significantly increased the cost of the coatings.

Pure tantalum is widely known to be inert with respect to many corrosive agents, including hydrochloric, nitric and acetic acids; lye; sea water; and chloridic solutions. Tantalum carbide, which is synthesized by the direct carbidization of tantalum powder and soot, or by the reaction of tantalum oxide with carbon at 1900° C. in an inert gas atmosphere, is known to possess high hardness and high resistance to corrosion except at elevated temperatures.

Tantalum metal is widely used in sheet form in the manufacture of different kinds of apparatus including vessels, heaters, steam condensers and pipe heat exchangers. Tantalum is rarely used for coating other metals, however. Though tantalum coatings might be formed by explosion or by precipitation from the vapor phase, these processes are expensive and do not guarantee sufficiently continuous, unbroken coverage of the base metals.

Soviet Author's Certificate No. 10 66 537 proposed a coating composition including 4 wt % nickel, 4 wt % chromium and 17 wt % tantalum. Coatings formed from this composition showed improved wear resistance but were relatively brittle. Furthermore, such coatings did not provide sufficient resistance to corrosion.

German Patent No. 42 38 220 proposed a composition for the diffusion coating of ferrous metals such as cast iron:

| | |
|---|---|
| Chromium | 50-60 wt % |
| Tantalum Carbide | 0.75–2.5 wt % |
| Ammonium Chloride | 1–3 wt % |
| Aluminum Oxide | Remainder |

This composition produced coatings with high wear and corrosion resistance. Nonetheless, the relatively large percentages of pure chromium and tantalum carbide required by the formulation raised the costs of the coated parts.

There remains a need in the art for an economical diffusion coating method and composition for forming effective wear and corrosion resistant surface layers over ferrous base metals.

SUMMARY OF THE INVENTION

The present invention provides a composition and method for use in diffusion protection of ferrous workpieces. The composition or mixture comprises both chromium and ferrochromium in combination with an ammonium halide and aluminum oxide. A preferred form of the composition also includes between 0.75 wt % and 1.35 wt % of microadditives selected from the group consisting of vanadium, tantalum, their alloys and mixtures thereof. In an especially preferred form, the composition comprises:

| | |
|---|---|
| Chromium | 40–50 wt % |
| Ferrochromium | 25–37 wt % |
| Tantalum Carbide | 0.40–0.65 wt % |
| Vanadium | 0.35–0.70 wt % |
| Ammonium Halide | 4–5 wt % |
| Aluminum Oxide | Remainder, |

the sum of all the components being 100 wt %. The preferred ammonium halide is ammonium chloride.

The invention also provides a relatively simple coating method which can be performed using conventional equipment. The components, in powdered form, are weighed and mixed in a container. The workpieces are preferably degreased, for example in a weak acid solution, and then placed in the container. Careful cleaning or scouring of the workpiece is not required.

The container is hermetically sealed and heated to a temperature of 1000°–1050° C. No protective atmosphere is required. The workpieces and the composition are kept at that temperature for a predetermined period, on the order of forty-five minutes or longer, of sufficient duration to permit a surface layer of desired thickness to form. The container is then cooled in a conventional cooling chamber and the workpieces are removed.

It has been found that the diffusion coating of workpieces of carbon steel or cast iron with the preferred coating composition forms a protective surface layer having mechanical properties akin to those of highly alloyed steels, with improved plasticity characteristics. More specifically, the preferred coating composition serves to form an ultra-hard surface layer. As a result of chemical and thermal processing of the base metal, the surface acquires high wear and corrosion resistance characteristics to satisfy the requirements for long-term performance in various environments.

The composition and method of the invention are preferably applied to high carbon and medium carbon steels. While less preferred, the composition and method of the invention do provide coatings with desirable properties on low carbon steels.

The inclusion of both chromium and ferrochromium in the composition of the present invention is believed to be unique. The waste products of metallurgical smelting typically include 68–70 wt % ferrochromium. The use of such waste products as a source of ferrochromium is believed to result in significant cost savings. Furthermore, the mixture of ferrochromium with chromium improves the alloying characteristics of the composition and provides for a better treatment of the base metal.

If the percentage of ferrochromium added is less than approximately 25 wt %, the composition does not produce a pore-free carbide layer which reduces the protective capability of the coating. If the percentage of ferrochromium is greater than approximately 37 wt % (or if the total percentage of chromium and ferrochromium exceeds the preferred limits of the invention), oversaturation occurs and the resulting surface is brittle and prone to fracture.

The addition of tantalum carbide in the range of 0.40–0.65 wt % increases the wear resistance of the surface layer. Likewise, the addition of vanadium in the range of 0.35–0.70 wt % improves the plasticity properties of the surface layer. If insufficient amounts of tantalum carbide and vanadium are used, the composition does not produce a pore-free surface layer. If excessive amounts of the microadditives are used, the cost of the composition is increased without significantly improving the properties of the surface layer.

Without wishing to be bound by any theory of operation, it is believed that, during chemical and thermal processing, the structure of the surface layer is formed by the diffusion of tantalum carbide and chromium carbide into vacancies in the surface. The vanadium fills the space between the carbides to form a continuous layer. During layer formation, the chromium carbides diffuse farther into the matrix of the base metal and fill deeper vacancies.

The carbides making up the solid, pore-free coatings produced by the composition and method of the invention have low diffusion mobility at room temperature. For example, the diffusion mobilities of chromium carbides and tantalum carbides are on the order of magnitude of ten times lower than the diffusion mobilities of pure chromium and tantalum in the crystalline structure of metal. As a result, the chromium and tantalum carbides formed on the workpiece surface as a result of the diffusion treatment are not inclined to diffuse into the structure of the base metal once the surface layer is formed.

The composition and method of the present invention are effective to form on carbon steels and cast irons diffusion coatings having Vickers hardnesses up to approximately 2200–2500 kg/mm$^2$ with porosities less than 0.1%. Further increases in hardness are possible, but may lead to undesirably low plasticity.

Workpieces of any geometric shape may be treated by the method of the invention. The only practical size limitation on the parts which can be treated by the method of the invention is the size of the furnace. The preferred surface layer thickness, 8–500 $\mu$m, is independent of the dimensions of the workpiece.

The diffusion coating method of the present invention is believed to be cheaper than electrodeposition methods. Unlike electrodeposition methods, the diffusion coating method of the present invention does not generate significant fumes harmful to workers or the environment. One significant advantage of the method of the invention is that the coating composition may be continuously refreshed and recycled, and the process may be operated so as to generate practically no waste.

The coating process of the present invention is believed to be applicable in many fields, including the engineering, chemical, oil and gas, agricultural, automotive, shipbuilding, electronics and communications industries. The process may also find application in the construction and consumer goods industries.

Therefore, it is one object of the invention to provide a composition and method for diffusion coating ferrous base metals to form surface layers having good wear and corrosion resistance while maintaining desirable plasticity characteristics. The invention will be further described in conjunction with the following detailed description.

DETAILED DESCRIPTION OF THE PREFERRED EMBODIMENT

The invention will be further explained in conjunction with the following examples which are included as being illustrative of the invention and should not be construed to limit the scope of the invention.

EXAMPLE 1

A mixture of the following components was weighed out and placed in a sealed container with a prismatic workpiece (65 cm×15 cm×3 cm) of carbon steel and three test samples of the same steel:

| | |
|---|---|
| Chromium | 45 wt % |
| Ferrochromium | 30 wt % |
| Tantalum Carbide | 0.55 wt % |
| Vanadium | 0.60 wt % |
| Ammonium Chloride | 4.5 wt % |
| Aluminum Oxide | Remainder |

The container was heated in a furnace at a temperature of 1050° C. for ninety minutes and then placed in a cooling chamber.

The test samples with the newly-formed protective surface layers were tested by means of (1) X-ray structural analysis and (2) Vickers micro-hardness analysis. The thickness of the diffused carbide layer was 12 $\mu$m. An upper portion of the surface layer was comprised of tantalum carbide, chromium carbide and vanadium. A lower portion of the surface layer was comprised of chromium carbides and a solid solution of chromium in iron.

The microhardness of the surface layer was 1900 kg/mm$^2$ Vickers. A scratch test using different degrees of pressure revealed the absence of cracks and showed that the surface possessed good wear resistance and plasticity characteristics.

In addition, the porosity of the surface layer was determined by placing a sheet of filter paper saturated in Vokker's reagent, a mixture of $K_3[Fe(CN)_6]$ and NaCl, over the surface layer. Were the surface layer porous, $[Fe(CN)_6]^{3-}$ ions from the reagent would combine with iron from the base metal to form Turnbull Blue, $Fe_3[Fe(CN)_6]$, creating blue spots on the filter paper over the locations of the pores, and the porosity of the surface layer could be characterized by the number of such blue spots per square centimeter. When the workpiece coated in the present example was tested, an absence of blue spots showed that the coating formed on the workpiece was pore-free.

EXAMPLE 2

Additional ferrous workpieces were coated according to the method of Example 1 using various pulverous coating compositions. The results are shown in Table 1 below:

| Test No. | Cr wt % | FeCr wt % | TaC wt % | V wt % | $NH_4Cl$ wt % | $Al_2O_3$ wt % | Base Metal % C | Micro-hardnes (HV) kg/mm$^2$ | Porosity spots/cm$^2$ | Brittle-ness |
|---|---|---|---|---|---|---|---|---|---|---|
| 1 | 40 | 37 | 0.40 | 0.50 | 5 | Balance | C Steel (0.45) | 1900 | 0 | No |
| 2 | 40 | 30 | 0.35 | 0.40 | 5 | Balance | C Steel (0.60) | 1700 | 0 | No |
| 3 | 50 | 39 | 0.40 | 0.60 | 4 | Balance | C steel (0.67) | 2800 | 0 | Yes |
| 4 | 50 | 25 | 0.45 | 0.70 | 5 | Balance | C Steel (0.50) | 1550 | 0 | No |
| 5 | 50 | 25 | 0.60 | 0.50 | 4 | Balance | Cast Iron (2.5) | 1600 | 0 | No |
| 6 | 50 | 29 | 0.40 | 0.45 | 4 | Balance | Cast Iron (2.5) | 1650 | 0 | No |
| 7 | 50 | 30 | 0.50 | 0.70 | 4 | Balance | C Steel (0.70) | 2200 | 0 | No |
| 8 | 50 | 27 | 0.60 | 0.60 | 5 | Balance | C Steel (0.45) | 1630 | 0 | No |
| 9 | 50 | 30 | 0.65 | 0.50 | 5 | Balance | C Steel (0.60) | 1950 | 0 | No |
| 10 | 45 | 32 | 0.45 | 0.35 | 5 | Balance | Cast Iron (2.5) | 2200 | 0 | No |
| 11 | 45 | 29 | 0.60 | 0.60 | 5 | Balance | C Steel (1.0) | 2400–2700 | 0 | No |
| 12 | 45 | 22 | 0.38 | 0.35 | 4 | Balance | C Steel (0.50) | 950 | 2–3 | Yes |
| 13 | 45 | 26 | 0.65 | 0.70 | 4 | Balance | C Steel (0.70) | 1800 | 0 | No |
| 14 | 45 | 30 | 0.40 | 0.58 | 5 | Balance | C Steel (0.65) | 1550 | 0 | No |
| 15 | 45 | 28 | 0.70 | 0.65 | 4 | Balance | C-42 Low Alloy Steel* | 1150 | 1–2 | No |

(*"C-42 Low Alloy Steel" includes 13.5 wt % chromium, 0.6 wt % silicon and 0.6 wt % manganese.)

The test results set forth in Table 1 showed the desirable properties of surface layers formed on carbon steels and cast irons by the method and composition of the invention. In Tests Nos. 1, 2, 4–11, 13 and 14, the method of the present invention resulted in surface layers having Vickers hardnesses of 1550 kg/mm$^2$ or greater without porosity or brittleness.

The test results set forth in Table 1 also showed the significance of the chromium/ferrochromium composition on the properties of the coating. The coating in Test No. 3, formed using a composition including 50 wt % chromium, 39 wt % ferrochromium, and microadditions was brittle. On the other hand, the coating in Test No. 12, formed using a composition including 45 wt % chromium, 22 wt % ferrochromium, 0.38 wt % tantalum carbide, and 0.35% vanadium was porous and relatively soft. These two tests suggest that compositions including 40–50 wt % chromium and 25–37 wt % ferrochromium are preferred to obtain optimum surface layer properties.

The preceding description is intended to be illustrative of the invention and not limiting. Various other modifications and applications will be apparent to one skilled in the art without departing from the true spirit and scope of the invention as defined in the following claims.

What is claimed is:

1. A method for forming a coating on a ferrous workpiece comprising the steps of:

a) forming a mixture from components including approximately 40–50 wt % chromium, approximately 25–37 wt % ferrochromium, approximately 4–5 wt % ammonium chloride, approximately 0.40–0.65 wt % tantalum carbide, approximately 0.35–0.70 wt % vanadium, and aluminum oxide, the sum of all the components being 100 wt %;

b) exposing the ferrous workpiece to the mixture; and c) heating the ferrous workpiece and the mixture to form a substantially pore free, chromium carbide containing corrosion resistant layer having a Vickers' hardness of about 1550 $Kg/mm^2$ or greater.

2. The method as recited in claim 1 wherein the step a) includes forming the mixture from components including approximately 45 wt % chromium, approximately 30 wt % ferrochromium, approximately 4.5 wt % ammonium chloride, approximately 0.55 wt % tantalum carbide, approximately 0.60 wt % vanadium, and aluminum oxide, the sum of all the components being 100 wt %.

3. The method as recited in claim 1 wherein the step a) includes forming the mixture from powdered components.

4. The method as recited in claim 1 wherein the step c) includes heating the workpiece and the mixture to a temperature of approximately 1000°–1050° C.

5. A ferrous workpiece having a coating formed by the method recited in claim 1.

6. A carbon steel workpiece having a coating formed by the method recited in claim 1.

7. A method for forming a coating on a carbon steel workpiece comprising the steps of:

a) forming a mixture from components including approximately 40–50 wt % chromium, approximately 25–37 wt % ferrochromium approximately 4–5 wt % ammonium chloride, approximately 0.40–0.65 wt % tantalum carbide, approximately 0.35–0.70 wt % vanadium, and aluminum oxide, the sum of all the components being 100 wt %;

b) exposing the carbon steel workpiece to the mixture in a container; and c) heating the ferrous workpiece and the mixture in the container to a temperature of approximately 1000°–1050° C. to induce diffusion of at least part of the components into the carbon steel workpiece.

8. The method as recited in claim 7 wherein the step a) includes forming the mixture from components including approximately 45 wt % chromium, approximately 30 wt % ferrochromium, approximately 4.5 wt % ammonium chloride, approximately 0.55 wt % tantalum carbide, approximately 0.60 wt % vanadium, and aluminum oxide, the sum of all the components being 100 wt %.

9. A composition for use in coating ferrous workpieces, the composition being a mixture of powdered components comprising approximately 40–50 wt % chromium, approximately 25–37 wt % ferrochromium, approximately 4–5 wt % ammonium chloride approximately 0.40–0.65 wt % tantalum carbide, approximately 0.35–0.70 wt % vanadium, and aluminum oxide, the sum of all the components being 100 wt %.

10. The composition as recited in claim 9 wherein the powdered components include approximately 45 wt % chromium, approximately 30 wt % ferrochromium, approximately 4.5 wt % ammonium chloride, approximately 0.55 wt % tantalum carbide, approximately 0.60 wt % vanadium, and aluminum oxide, the sum of all the components being 100 wt %.

11. A composition for forming a diffusion coating on a carbon steel workpiece, the composition being a mixture of powdered components comprising approximately 40–50 wt % chromium, approximately 25–37 wt % ferrochromium, approximately 4–5 wt % ammonium chloride, approximately 0.40–0.65 wt % tantalum carbide, approximately 0.35–0.70 wt % vanadium, and aluminum oxide, the sum of all the components being 100 wt % said coating being substantially pore free and including chromium carbide therein, said coating having a Vickers' hardness of about 1550 $Kg/mm^2$ or greater.

12. The composition as recited in claim 11 wherein the powdered components include approximately 45 wt % chromium, approximately 30 wt % ferrochromium, approximately 4.5 wt % ammonium chloride, approximately 0.55 wt % tantalum carbide, approximately 0.60 wt % vanadium, and aluminum oxide, the sum of all the components being 100 wt %.

* * * * *